US005891008A

United States Patent [19]

Bavely et al.

[11] Patent Number: 5,891,008

[45] Date of Patent: Apr. 6, 1999

[54] SHEET PRODUCTS FOR USE IN A POP-UP DISPENSER AND METHOD FOR FORMING FROM STRETCHED RIBBONS

[75] Inventors: Jane L. Bavely, Cincinnati; Charles J. Berg, Jr., Wyoming, both of Ohio

[73] Assignee: The Procter & Gamble Company, Cincinnati, Ohio

[21] Appl. No.: 574,437

[22] Filed: Dec. 15, 1995

[51] Int. Cl.[6] ..... B65H 493/410; A47K 10/24

[52] U.S. Cl. ..... 493/405; 493/406; 493/410; 493/458

[58] Field of Search ..... 493/405, 211, 493/83, 338, 339, 459, 460, 465, 466, 410, 458, 461, 421, 413, 401, 408, 409; 264/288.8, 289.3; 206/494, 812, 554; 706/994, 8 R, 559

[56] References Cited

U.S. PATENT DOCUMENTS

| | | |
|---|---|---|
| 1,385,569 | 7/1921 | Mayer et al. . |
| 1,979,876 | 11/1934 | Fischer . |
| 2,211,494 | 8/1940 | Christman . |
| 2,353,183 | 7/1944 | Niederauer . |
| 2,477,223 | 7/1949 | West . |
| 3,066,932 | 12/1962 | Greiner et al. . |
| 3,172,564 | 3/1965 | Enloe et al. . |
| 3,248,102 | 4/1966 | Couzense et al. . |
| 3,282,525 | 11/1966 | Rehr . |
| 3,307,844 | 3/1967 | Stults . |
| 3,462,043 | 8/1969 | Frick . |
| 3,486,957 | 12/1969 | Fish et al. . |
| 3,542,356 | 11/1970 | Murphy et al. . |
| 3,848,501 | 11/1974 | Kuts . |
| 3,862,610 | 1/1975 | Brocklehurst . |
| 3,965,785 | 6/1976 | Johns . |
| 4,002,092 | 1/1977 | Smith et al. . |
| 4,010,664 | 3/1977 | Marshall . |
| 4,055,697 | 10/1977 | Schmanski . |
| 4,106,166 | 8/1978 | Henning . |
| 4,131,271 | 12/1978 | Slawny . |
| 4,223,426 | 9/1980 | Demiere . |
| 4,266,112 | 5/1981 | Niedemeyer . |

(List continued on next page.)

FOREIGN PATENT DOCUMENTS 1454971 10/1964 Germany .

OTHER PUBLICATIONS

The mechanics of web spreading: Part 1 *Web Spreading*, vol. 76, No. 10 Tappi Journal, pp. 63–70.

*Primary Examiner*—John Sipos
*Assistant Examiner*—Christopher W. Day
*Attorney, Agent, or Firm*—Williams Scott Andes; Carl J. Roof; E. Kelly Linman

[57] ABSTRACT

An improved method is disclosed for forming a strata of overlapping sheets suitable for use in a pop-up dispensing system. The sheets are cut from ribbons which initially have edges essentially parallel to the longitudinal axis of the ribbon. At least one side edge of each ribbon is stretched to form a knee-like protrusion, with the opposing side edge being either, substantially parallel to the longitudinal axis of the ribbon, or also stretched to form one or more knee-like protrusions on the opposing edge. The ribbons are then aligned so that a knee-like protrusion on one edge aligns with either the essentially parallel edge of an adjacent ribbon or a knee-like protrusion on the side edge of an adjacent ribbon. After phasing, the ribbons are overlapped creating a series of predetermined areas of greatest overlap adjoining areas of least or no overlap, such that successive ribbons are bonded only by the interfacial interaction between each ribbon. By overlapping multiple ribbons in this manner a strata is formed which is then folded to interleave the ribbons. A resulting stack of interleaved ribbons is cut in a direction essentially normal to the longitudinal axis of the ribbons at predetermined intervals to form blocks of individual interleaved sheets. The process can be accomplished manually or in a continuous production process.

16 Claims, 4 Drawing Sheets

U.S. PATENT DOCUMENTS 4,300,891 11/1981 Bemiss .
4,340,441 7/1982 Thwaites et al. .
4,416,376 11/1983 Scheffers et al. .
4,425,109 1/1984 Konsti et al. .
4,480,772 11/1984 Gerndt .
4,574,670 3/1986 Johnson .
4,609,366 9/1986 Ley et al. .
4,630,514 12/1986 Ohmori et al. .
4,650,451 3/1987 Herrington ..... 493/190
4,654,021 3/1987 Herrington ..... 493/211
4,654,180 3/1987 Herrington ..... 264/288.8
4,664,006 5/1987 Mitchell .
4,684,259 8/1987 Herrington ..... 493/211
4,748,909 6/1988 Theilacker .
4,922,775 5/1990 Winter .
5,328,053 7/1994 Cook et al. .
5,332,118 7/1994 Muckenfuhs .
5,424,025 6/1995 Hanschen ..... 264/288.8
5,540,332 7/1996 Kopacz et al. .

SHEET PRODUCTS FOR USE IN A POP-UP DISPENSER AND METHOD FOR FORMING FROM STRETCHED RIBBONS

FIELD OF INVENTION

This invention relates to an improved strata arrangement of sheets for use in a pop-up dispensing system, and method for forming sheets from stretched ribbons which are oriented into a substantially continuous strata.

BACKGROUND OF THE INVENTION

Disposable towelettes and similar sheet products, sometimes generally referred to as "wipes", which are dispensed from a container, or from individually wrapped packages, have become a fixture in today's society. For example, wipes are used for hygienic purposes as well as routine, nonhygienic cleaning and wiping. The size, shape, thickness, durability, moisture content, and lotion content of the wipe can all be adjusted for a variety of uses, and the versatility of such products has contributed to the popularity of wipes in general.

Due to the variety of uses for sheet products such as wipes, they have taken on numerous physical forms, and their dispensing mechanisms have likewise been varied. There are a variety of dispensing mechanisms that involve containers and some that do not. For example, rolls of dry paper towels and toilet paper do not require containers because of their low moisture content. "Dry" sheet products often include lotions or other additives and are not necessarily moisture free. Rather "dry" sheet products are sheets with low moisture content that are generally dry to the touch of an average consumer. Paper towels and toilet paper are generally in the form of rolled continuous sheets with perforations defining the individual leaves. A consumer unrolls the number of leaves that he or she needs and tears them from the roll along the perforations between leaves.

Often sheets are premoistened with lotions, cleansing agents or the like. A popular method for dispensing moistened sheets, "wet wipes", is a combination of the perforated roll and the container dispenser. Ribbons of sheets are often perforated, rolled, placed in a rigid container and then lotions and/or cleansing agents are added. For dispensing, individual wet wipes are generally pulled through a small aperture in the container and then torn along the perforations to remove the sheet. Problems with such arrangements can arise as the dispensing aperture is typically small to minimize evaporative loss of moisturizing agent from the products closest to the top. The smaller sized aperture, in turn, requires an increase in force to withdraw the wipe from the dispenser. The increased force can result in premature tearing of perforations between products to be dispensed, or may require designing perforations with increased resistance to tearing, thereby requiring additional force by the user to separate a product for use. Often, two hands are required to extract a treated or "wet wipe" (i.e. one hand to remove a wipe and the other to secure the container while the wipe is being removed from the container and torn from the next wipe). Unfortunately, however, sheet products such as wipes are often needed when only one hand is available (e.g. when cleaning an infant), which makes perforated wipes dispensed from a container an undesirable combination.

Another common form of wipes that are not dispensed from a rigid container includes the individual prepackaged wet wipes often handed out at restaurants or on airplanes. These wet wipes are often folded and placed in individual moisture resistant pouches, then lotion and/or a cleansing agent is added, and the pouch is heat sealed. The consumer tears open the package to use the wipe, and then disposes of both the pouch and the wipe. Typically, this is also a two-handed operation, and there is considerable waste created in the form of the individual pouches, making this method of packaging and dispensing undesirable as well.

For generally dry sheets, a known manner of dispensing individual (i.e. pre-cut, interfolded, non-perforated) sheets is through a dispensing container. The dispensing container can be a box with a lid that is opened each time a sheet is needed, it can be a box with a lid and an aperture that individual sheets are pulled through, or it can be a combination of both a lid and an aperture. Generally dry sheets dispensed through a box with an aperture are typically rectangular and interfolded. Tissues and paper towels in restrooms are often dispensed in this manner.

As currently practiced, dispensing an interfolded sheet involves pulling one edge of an essentially rectangular sheet away from the dispenser. The interleaved portion of the two sheets serves to pull the adjacent portion of the next sheet due to the interfacial interaction of the two sheets at the overlap area. After the first sheet has been completely pulled through the aperture the two interfolded sheets begin to quickly separate. When the two sheets are completely separated, there should be a sufficient amount of the second sheet extending outside of the dispensing aperture to allow easy subsequent access to the second sheet. The portion of the second sheet remaining above the dispenser is commonly referred to as the "tail".

Dry sheets or tissues dispensed in this manner generally have a large overlap area consisting of an entire side of the rectangular sheet interfolded with an edge of the next sheet. However, as moisture is added to a sheet product, the large surface area of overlap often results in excessive interactive forces between the two sheets, causing a second sheet to be dispensed along with the first sheet due to the larger force required to separate the two sheets. Decreasing the surface area of overlap is difficult because this decreases the adhesive force, which controls the amount of the second sheet removed from the dispenser (to provide the "tail" for subsequent dispensing).

Currently, sheets that are moist, thick and non-woven, cannot be dispensed by interleaving the sheets, as, due to the adhesion between sheets caused by the presence of high levels of moisture, the force required to separate two sheets is so great that multiple sheets are often dispensed with one pull (sometimes called "chaining"). Therefore, the sheets are typically folded individually and stacked one on top of the other and placed in a dispensing container. This dispensing method is less than optimal because there is no convenient tail to grab when a sheet is needed, generally resulting in a two-handed dispensing procedure.

U.S. Pat. No. 5,332,118 to Muckenfuhs (the '118 patent), discloses a series of designs for sheets that can be folded and used in a pop-up dispensing mechanism without the dispensing difficulties discussed above. The entire disclosure of the '118 patent is hereby incorporated herein by reference. An improved sheet design and method for forming sheet products, as described in the '118 patent, for use in pop-up dispensing applications is provided herein.

Automated methods for folding a series of continuous ribbons into a continuous strata of overlapping sheets for use in a pop-up dispensing system are known to the art. Machines of this type have been used for folding continuous ribbons that have edges which are essentially straight and parallel to the longitudinal axis of the ribbons, e.g. tissues.

Once the ribbons are interfolded, interleaved continuous stacks are produced, which are cut into blocks suitable for use in a pop-up dispenser.

Clearly, prior devices separately teach specific folding means, but continuing enhancement of sheet products for improved pop-up dispensing performance, as well as a better method for economically and efficiently producing such products, has been needed. There is a continuing need for improved sheet products and a method of manufacturing sheets that can be used effectively in a pop-up dispensing system. Further, there is a need for an improved process whereby ribbons can be, stretched, overlapped accurately and consistently, folded and cut into sheets for use in a pop-up dispensing system.

SUMMARY OF THE INVENTION

It is a primary object of this invention to provide an improved sheet, and method for forming a substantially continuous strata of such sheets, for use in an interleaved pop-up dispensing system.

It is a further object of this invention to enable sheet products for pop-up dispensing applications to be more efficiently cut and stretched individually or continuously from a wider continuous web of material.

It is also an object of this invention to produce the improved sheets of this invention while minimizing waste.

It is yet a further object of this invention to accomplish all of the above manufacturing improvements for both wet and dry sheets.

In accordance with one aspect of this invention, there is provided a method of forming ribbons of sheet material having a longitudinal axis between two opposing side edges, and stretching the side edges of the ribbons to form one or more knee-like protrusions on the side edges. The knee-like protrusions of one ribbon are aligned in a predetermined manner with the protrusions of an adjacent ribbon, and overlapping those aligned ribbons to create predetermined areas of greatest overlap and least overlap therebetween. The aligned and overlapped ribbons are then folded into continuous stacks and then cut into discreet blocks of interleaved individual sheets for use in a pop-up dispensing system.

In another preferred embodiment, there is provided a method of forming ribbons having a longitudinal axis and two opposing side edges, then stretching one side edge of the ribbons to form one or more knee-like protrusions thereal-ong. The opposing side edge of the ribbon remains essentially parallel to the longitudinal axis of the ribbon. Thereafter, the knee-like protrusions of one ribbon are aligned with the essentially parallel side edge of an adjacent ribbon. Ribbons aligned in this manner are then overlapped, creating an area of greatest overlap between the knee-like protrusions of one ribbon and the essentially parallel edge of the adjoining ribbon. Each area of greatest overlap is adjoined by an area of least overlap between adjoining ribbons. Multiple ribbons can be overlapped in this manner forming a substantially continuous strata of ribbons which is then folded into a continuous stack of interleaved ribbons. The continuous stack is then cut in a direction essentially normal to the longitudinal axis of the ribbons forming discreet blocks of individual interleaved sheets. In a preferred embodiment the substantially continuous stacks are cut near the midpoint at each knee-like protrusion, and cut again approximately halfway between knee-like protrusions.

Those processes discussed above can be accomplished in a continuous manufacturing process where the ribbons are cut and stretched from a wider web of fabric.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1A:
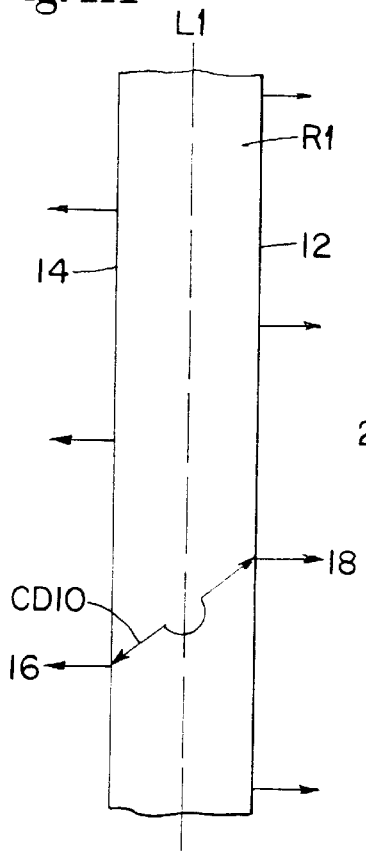
FIG. 1A is a partial schematic plan view of a ribbon of material prior to cross directional stretching, with arrows indicating the direction of force with which the ribbon will be stretched.
Figure 1B:
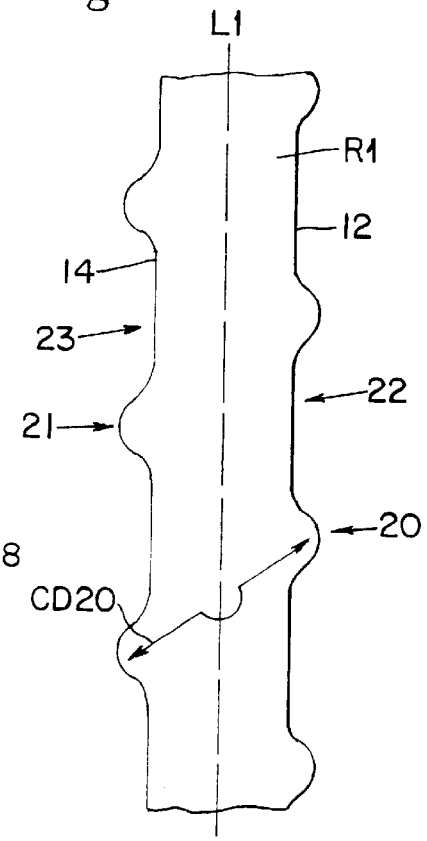
FIG. 1B is a partial schematic plan view of the ribbon of FIG. 1A after stretching.

Referring now to the drawings in detail, wherein like numerals indicate the same elements throughout the views, and wherein elements having the same final two digits (e.g., 12, 112, 212) indicate comparable elements of various preferred embodiments, FIG. 1A illustrates a partial plan view of a ribbon R1 with two opposing side edges 12 and 14 deposed about a longitudinal axis L1. Along the side edges 12 and 14 are illustrated schematically a plurality of periodically spaced force, arrows (e.g. 16 and 18). The forces indicated by arrows 16 and 18 are shown approximately perpendicular to the longitudinal axis L1 of the ribbon R1 and substantially perpendicular to the relatively parallel side edges 12 and 14 of ribbon R1 prior to stretching. As will be discussed in greater detail, forces applied in this manner will form knee-like protrusions on the side edges as depicted in FIG. 1B, 20 and 21. As used herein, the term "knee-like protrusion" is a portion of the fabric material that, after the fabric has been stretched, extends further from the longitudinal axis of the ribbon than the side edge prior to stretching. A variety of alternatives for the shapes and designs of knee-like protrusions can be found in the aforementioned Muckenfuhs patent.

The cross directional width of a ribbon CD10 prior to stretching, is the distance from the point on one edge 14 of a ribbon R1 where a stretching force 16 will be applied, to the nearest point on the opposing side edge 12 where a stretching force 18 will be applied.

FIG. 1B further shows a ribbon R1 with two side edges 12 and 14 deposed about a longitudinal axis L1 which has been stretched to increase the cross-directional width CD20. Adjoining each knee-like protrusion 20 and 21 is a corresponding recess, or cavity 22 and 23 respectively, which represents the area of the ribbon that has not been stretched or is on the opposing side edge (e.g. 23) from a point where a stretching force has been applied and a knee-like protrusion has been formed (e.g. 20).

Figure 2A:
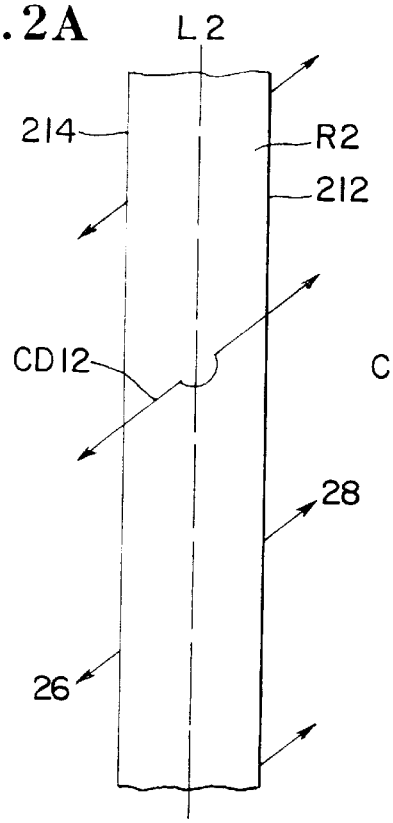
FIG. 2A is a partial schematic plan view of a ribbon of material prior to angular directional stretching, with arrows indicating the direction of force with which the ribbon will be stretched.
Figure 2B:
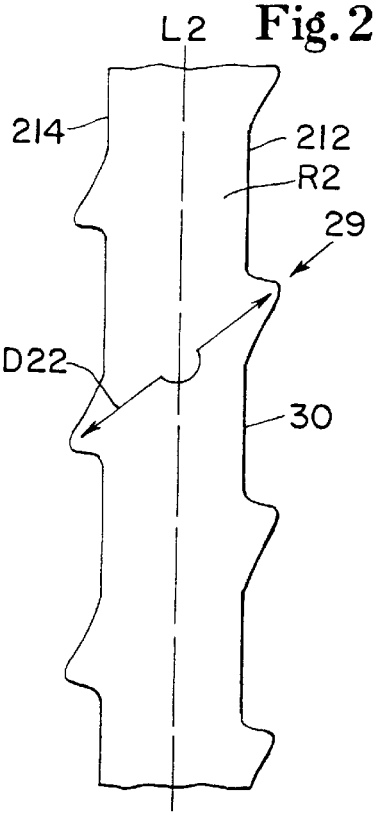
FIG. 2B is a partial schematic plan view of the ribbon of FIG. 2A after stretching.

FIG. 2A is another partial plan view of a ribbon R2 having two opposing side edges 212 and 214 centered about a longitudinal axis L2 with the direction of the stretching forces shown with arrows (e.g. 26 and 28). To form the sheets of this invention, ribbons can be stretched in any manner that effectively produces the knee-like protrusions on at least one side edge. Forces 26 and 28 are angled but generally in a direction away from the longitudinal axis L2, as are 16 and 18 of FIG. 1A, and both will produce the knee-like protrusion (e.g. FIG. 1B, 20 and 21). It is likely that the shape of the knee-like protrusions (e.g., FIG. 2B, 29) formed by angular forces (e.g FIG. 2A, 26 and 28), may not be the same shape as the knee-like protrusions formed by perpendicular forces (e.g. FIG. 1A, 16 and 18). The ability to adjust the size and shape of knee-like protrusions formed on the edge of the ribbons may aid a sheet designer in optimizing ribbon edge geometry to produce sheets with superior dispensing qualities.

Figure 3:
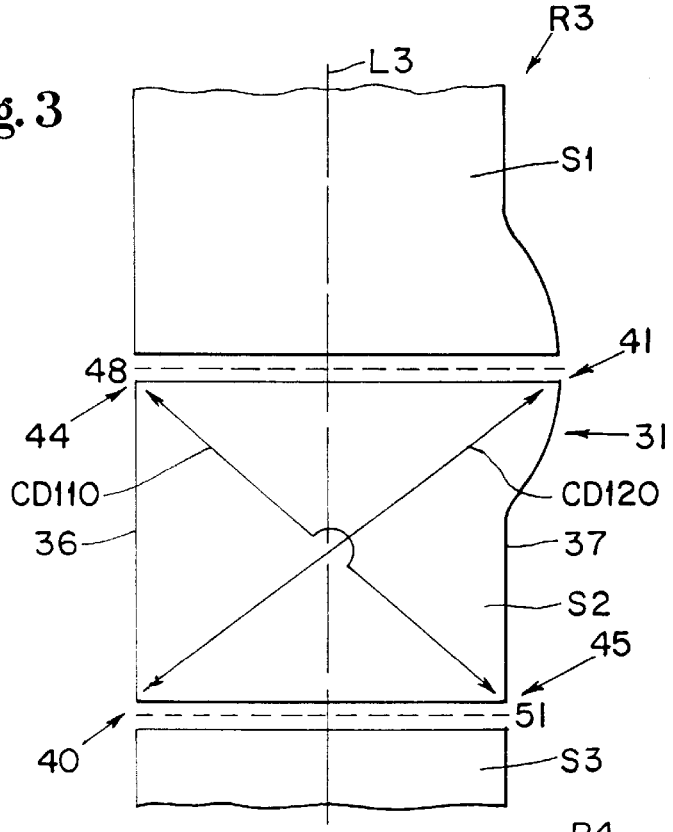
FIG. 3 is an enlarged plan view of one sheet and sections of the ribbon that the sheet was cut from, wherein the sheet has a single knee-like protrusion formed adjacent one of its four corners.

Ribbons R1 and R2 can be manufactured by any means currently available. Preferably, the ribbons are manufactured by a continuous process where a wide based web of material is passed through a cutting station and is slit into ribbons having edges essentially parallel to the machine direction of the web. Slitting can be accomplished by a variety of means, e.g. lasers, waterjets, blades, or the like. Ribbons can also be formed by passing a substantially continuous web over a rotating die cutter which slits the web into uniform individual ribbons. It is generally preferable that at least four ribbons be formed from such a relatively wide based web of material FIG. 3 shows a plan view of a plurality of adjacent sheets S1, S2 and S3 cut from a ribbon R3 where knee-like protrusions have been formed on one edge 37 of the ribbon R3. The opposing side edge 36 is illustrated as being essentially parallel to the longitudinal axis L3 of ribbon R3. The ribbon R3 is cut at the approximate mid-point of each knee-like protrusion (i.e., along line 48) and again approximately half way between knee-like protrusions (i.e., along line 51) to form the individual sheets. Sheets stretched and cut in this manner have only one corner 41 on which there is a knee-like protrusion 31 formed.

Figure 4:
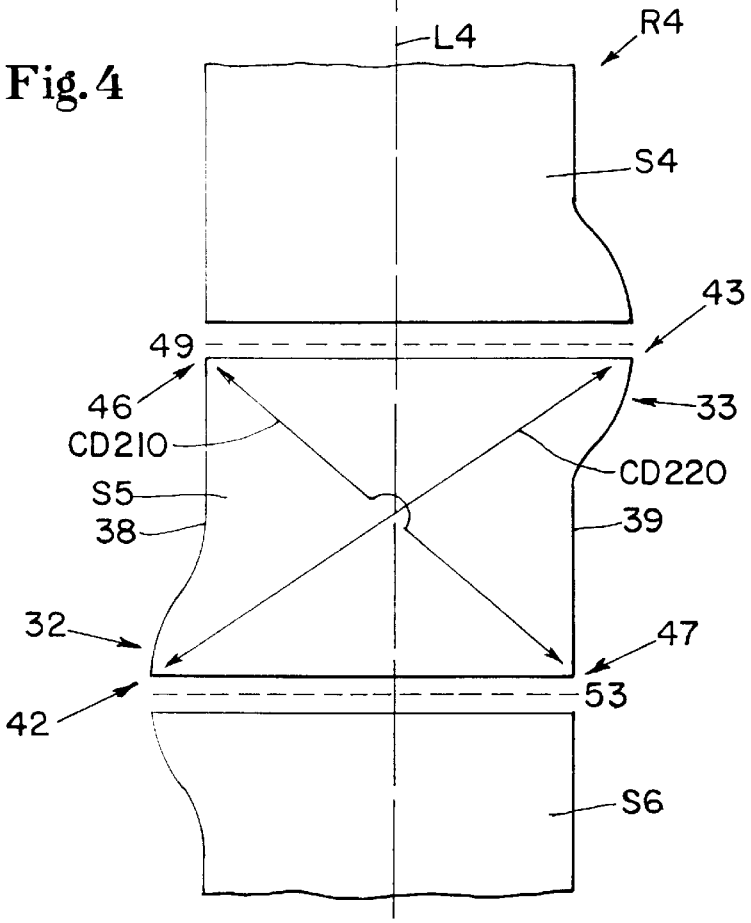
FIG. 4 is an enlarged plan view of a sheet and two sections of the ribbon that the sheet was cut from, wherein knee-like protrusions have been formed along both side edges of the ribbon, causing the sheet to have knee-like protrusions adjacent two of its four corners.

FIG. 4 depicts an alternate sheet configuration similar to that shown in FIG. 3, except that knee-like protrusions 32 and 33 are formed on two sides of the ribbon R4 to form individual sheets as depicted by S4, S5 and S6, respectively. There are knee-like protrusions 32 and 33 formed on two of the corners 42 and 43. Corners 46 and 47 are illustrated as preferably located where there are no knee-like protrusions, i.e. corners 46 and 47 are in the recesses or cavities 38 and 39 on the edges of the ribbon R4 which occur approximately half way between adjacent knee-like protrusions. Cut lines 49 and 53 are illustrated as situated at the approximate mid-point of each knee-like protrusion 32 and 33, which in this case is also half way between knee-like protrusions on opposing side edges. As will be understood, cutting the adjacent sheets S4–S6 at the approximate mid points of knee-like protrusions, and again at points equidistant between each successive knee-like protrusion, is preferred because this method creates two knee-like protrusions on adjacent sheets, from one knee-like protrusion formed on the edge of the ribbon, thus simplifying the manufacturing process.

Both FIGS. 3 and 4 show the elongation of the cross-directional distance when the ribbons (e.g., R3 and R4) are stretched to form the knee-like protrusions. In Sheet S2 of FIG. 3, for example, the cross-directional distance CD120 is greater in length than the cross-directional distance CD110, where CD120 is the distance between corners 40 and 41, and where corner 41 contains a knee-like protrusion 31. CD110 is the distance between corners 44 and 45, where neither corner has a knee-like protrusion. Similarly, FIG. 4 shows the diagonals CD210 and CD220 of Sheet S5, where the cross-directional CD220 is the distance between corners 42 and 43, both of which have knee-like protrusions (e.g., 32 and 33) formed thereon. The cross-directional distance CD220 has been stretched to a length significantly longer than the cross-directional distance CD210. The cross-directional distance CD210 is the distance between corners 46 and 47 of sheet S5 where 46 and 47 fall at the approximate mid-point of the recesses or cavities formed between adjacent knee-like protrusions.

Figure 5:
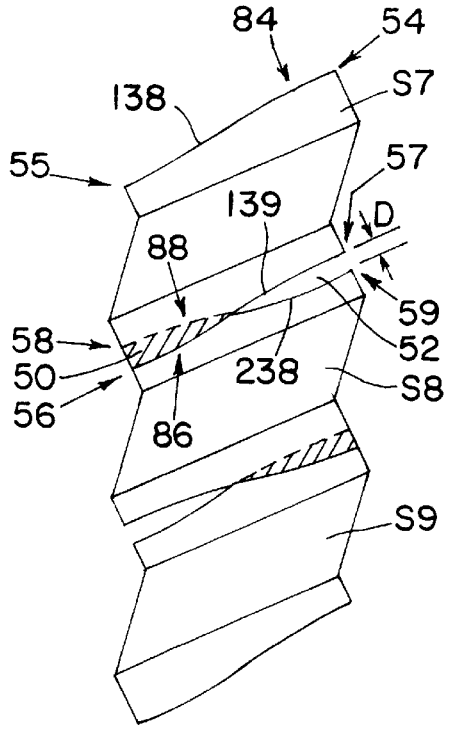
FIG. 5 is a partial view of three successive sheets cut from ribbons that have been stretched to form knee-like protrusions on both opposing side edges, and wherein the sheets are shown with predetermined areas of overlap, non-overlap, and the lines along which they are folded to interleave the sheets.

FIG. 5 is a perspective view of three sheets S7, S8, and S9 made in accordance with the subject invention where the sheets have been overlapped and interfolded. The sheets S7, S8, and S9 have been cut from ribbons that were stretched on both sides to form knee-like protrusions (e.g., 84 and 86 of S7) on two corners (e.g., 56 and 54 of sheet S7). Corners 57 and 55 are again preferably located coincidental with the recesses or cavities along the edges 138 and 139 respectively of the sheet S7. Corner 58 of sheet S8 is underlapped with corner 56 of sheet S7 forming the area of overlap 50. Corners 57 of sheet S7 and 59 of sheet S8, both of which are preferably located coincidental with the recesses or cavities along the respective edges 139 and 238 of sheets S7 and S8 respectively, form the area of least overlap 52. Distance D is equal to the distance between sheet S7 and S8 at the position where there is the least overlap between the two sheets. Distance D is a critical dimension discussed in greater detail below with respect to the appropriate interleaving of adjacent overlapping sheets for use in pop-up dispensers and the like. It is crucial to understand that distance D can be a number greater than, less than, or equal to zero, where values for D greater than zero indicate a gap between the two corners (e.g. 57 and 59) with no overlap; where a value of D is equal to zero indicates the two corners (e.g. 57 and 59) touch but do not overlap and where; a value for D is less than zero there is an area of overlap between the two corners (e.g. 57 and 59).

Figure 6:
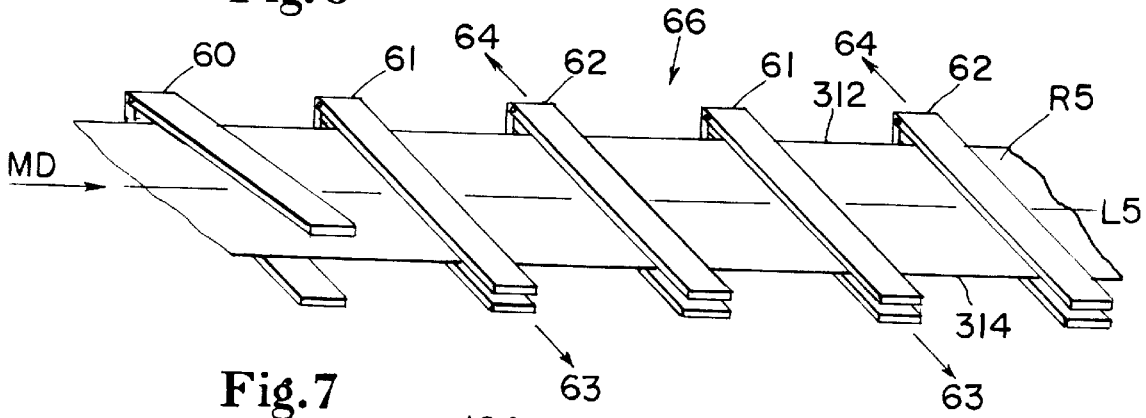
FIG. 6 is a partial perspective view of a continuous mechanical stretching arrangement for implementing the method of the present invention.

FIG. 6 is a partial perspective view of a continuous mechanical arrangement for stretching the ribbons of sheet material in accordance with this subject invention. The ribbon R5 travels in a predetermined machine direction (e.g., MD) illustrated as being essentially parallel to the longitudinal axis L5 of the ribbon R5, and through a stretching station 66. The stretching station 66 comprises individual, uniformly spaced stretching devices (e.g. 60, 61 and 62) which contact the ribbon to apply a stretching forces essentially perpendicular to the longitudinal axis L5, each stretching device applying a force opposite in direction to the stretching devices that adjoins it (e.g. 61 and 62). The direction of force applied by stretching devices 61 and 62 are generally indicated by arrows 63 and 64 respectively.

Figure 7:
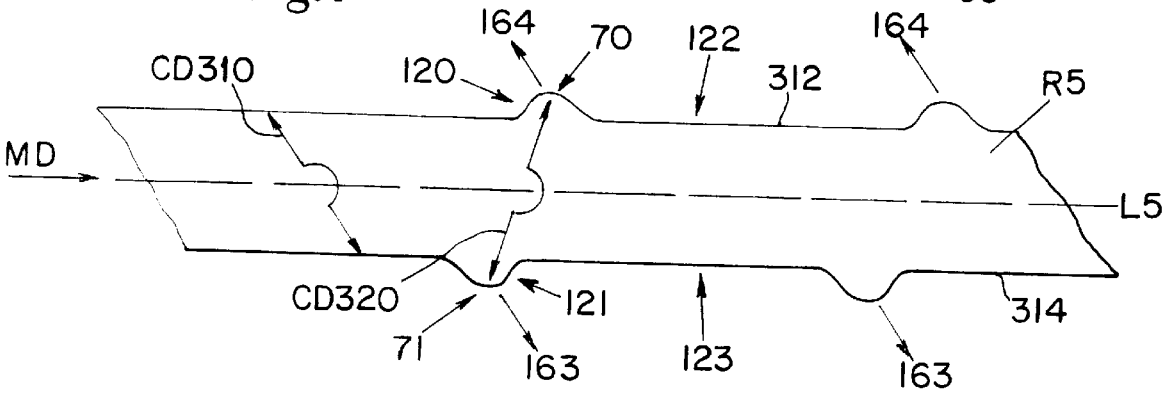
FIG. 7 is a partial perspective view of a ribbon stretched by the arrangement of FIG. 6.

FIG. 7 shows ribbon R5 after it has been stretched by passing through a stretching station (e.g. FIG. 6, 66). The effect of the stretching devices is best seen with respect to the longitudinal axis L5. The first knee-like protrusion 121 is formed by stretching device 61 that applies a force in the direction of arrow 163. The apex 71 of the knee-like protrusion 121 is significantly further from the longitudinal axis L5 than the area 122 on the opposing side edge 312. Adjoining the knee-like protrusion 121 on side edge 314 is a recess or cavity 123 created by stretching device FIG. 6, 62 applying a force in the direction of the arrow 164 on FIG. 7. The stretching device 62 creates the knee-like protrusion 120.

The cross-directional distance from the apex 70 of one knee-like protrusion 120 to the nearest apex 71 of a knee-like protrusion on the opposing edge 121, is CD320. The distance between knee-like protrusions on opposing edges is considerably larger than the cross-directional distance CD310 which is the distance between cavities (e.g. 122 and 123) on opposing edges 312 and 314. Forming the knee-like protrusions (e.g. 120 and 121) on the edges of a ribbon (e.g. 312 and 314 of R5), is important to the final performance of the sheets made in accordance with this invention because it is the resulting areas of greatest overlap and least overlap between knee-like protrusions on sheets that yields the superior dispensing qualities for sheets made in accordance with the present invention. However, the cross-directional distances CD320 and CD310 are useful for characterizing the shape of the resulting ribbon prior to overlapping, folding and interleaving of the ribbons before they are cut into individual sheets.

Figure 8:
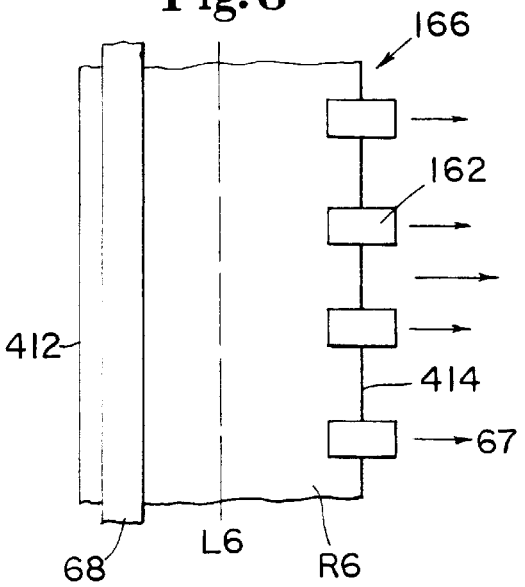
FIG. 8 is a partial schematic view of a single sided stretching arrangement of the present invention, wherein knee-like protrusions are formed on only one side edge of a ribbon.

FIG. 8 shows a partial schematic illustration of a preferred stretching station 166 where a stationary longitudinal clamping device 68 clamps a ribbon R6 near its side edge 412, while a plurality of lateral stretching devices (e.g. 162) are positioned along the opposing side edge 414 of ribbon R6. The stretching devices (e.g. 162) are moved in a direction indicated by arrows (e.g. 67) generally away from the longitudinal axis L6 in order to form knee-like protrusions (e.g. 220, FIG. 9) on the side edge 414.

Figure 9:
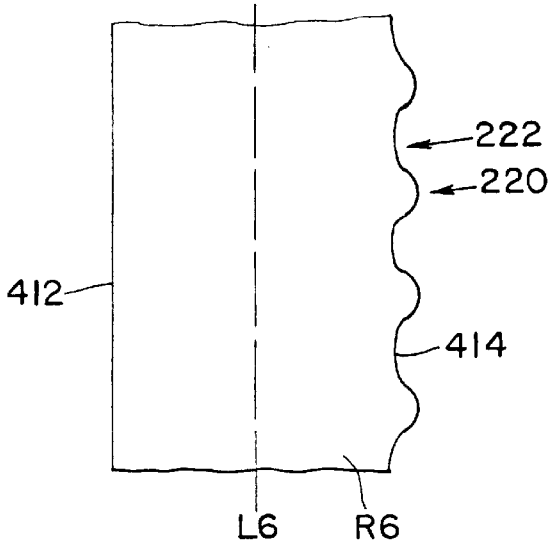
FIG. 9 is a partial plan view of a ribbon stretched by an arrangement such as FIG. 8 with knee-like protrusions formed on only one side edge.

FIG. 9 is a partial plan view of ribbon R6 after it has been stretched in the stretching station 166 as depicted in FIG. 8. Knee-like protrusions (e.g. 220) and corresponding recesses or cavities (e.g., 222) between protrusions are formed on the side edge 414 of ribbon R6. The opposing side edge 412 of ribbon R6 remains essentially parallel to the longitudinal axis L6 as a result of the longitudinal clamping device 68.

After stretching, a plurality of substantially identical ribbons are aligned and overlapped so that a knee-like protrusion on the edge of one ribbon is overlapped with a knee-like protrusion on an adjoining ribbon, or is overlapped with an edge that is essentially parallel with the longitudinal axis of the ribbon. This creates areas of greatest overlap 50 and least overlap 52 between adjoining ribbons as shown on FIG. 5, a plurality of overlapped ribbons, herein referred to as a strata, is created. As discussed below, the strata is folded and cut into individual blocks which are essentially a folded strata of sheets. Therefore the term strata is used to describe the overlapped, layered nature of the sheet material, regardless of whether the material is in the form of ribbons or sheets.

A critical design dimension which optimizes the dispensing parameters for the individual sheets (e.g., S7, S8 and S9) is depicted in FIG. 5 as "D". D is the nominal distance from one sheet edge (e.g., 238 of S8) to the adjoining sheet edge (e.g., 139 of S7) at the point of least overlap. As was previously described, the distance D can be greater than, less than, or equal to zero to account for a gap between the comers of adjoining sheets, an area of overlap between the comers of the sheets, or when the corners of adjoining sheets touch but do not overlap, respectively. For hand sheets and the like, for example, a target distance for D might be from about 2 mm to approximately 12 mm at the point of least overlap, or more preferably between about 5 mm and 7 mm. The size and shape of the protruding area, and subsequently the size and shape of the area of overlap, can also be adjusted while maintaining a constant gap distance D. The Muckenfuhs Patent (the '118 patent), incorporated herein by reference, discusses the overlapping, interleaving and dispensing of sheets in detail. Although the sheet products, and method of manufacture of the present invention are not discussed in Muckenfuhs, the general principles of areas of greatest overlap and least overlap between sheets is applicable to the present invention.

An example web material that is suitable for making the ribbons of the present invention which is soft, highly stretchable (in the cross-machine direction) and nonwoven has properties (on a dry basis) of:

| PROPERTY | UNITS | RESULT |
|---|---|---|
| Grab Tensile, MD Dry | grams | 7536 |
| Grab Tensile, CD Dry | grams | 2497 |
| MD Dry Grab Stretch | % | 37.3 |
| CD Dry Grab Stretch | % | 178.5 |
| Basis Weight | g/sq m | 61.5 |
| Absorbent Capacity | g/g | 11.1 |
| Sink Time | seconds | 1.3 |
| Cantilever Drape, MD | meters | 0.067 |
| Cantilever Drape, CD | meters | 0.029 |
| Thickness, Ames | microns | 704 |

Such a material is commercially available from Veratec, 100 Elm Street, Walpole, Mass. under the trade name "HEF #BD94-18". This example material is a 50/50 blend of polyester and rayon and is consolidated by hydroentanglement.

Figure 10:
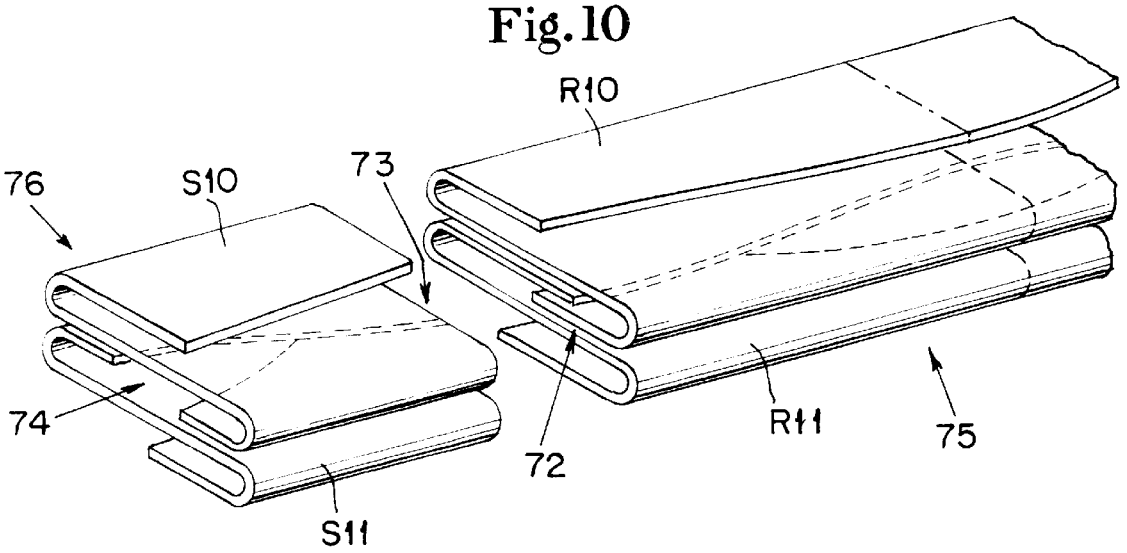
FIG. 10 is a partial perspective view of a partial block of interleaved, folded sheets, cut from a substantially continuous stack of interleaved, folded ribbons.

Once a plurality of ribbons have been overlapped in side by side relationship, they must be folded into a stack (as shown in FIG. 10, 75) of interleaved ribbons R10 and R11 and then cut into blocks 76 of individual interleaved sheets S10 and S11. Folding machines can be utilized for the automatic folding of a continuous strata of overlapped ribbons. Interleaving and folding machines are well known in the "tissue" art. As a practical matter, the process of overlapping and folding of continuous ribbons can be completed essentially simultaneously in a folding machine such as those currently used in the "tissue" industry. The overlapping and folding steps are discussed separately throughout this disclosure primarily for the purpose of clarity. Although z-folding is the preferred method for interleaving sheets of this invention, a variety of common folding processes can be used, including c- and u-folding.

As can be understood, the number of ribbons in a stack determines the number of sheets in a block. The desired number of sheets in the final block can be obtained by overlapping a corresponding number of ribbons (e.g. to produce an eighty count box of tissues, eighty ribbons are stacked and interfolded and each block cut therefrom will contain eighty tissues).

Another process common in the industry is the manufacturing of "clips" of product. A clip is a stack of sheets that is smaller in number than the desired final product. Clip folding and stacking machines common to the art produce stacks of four to ten ribbons which can be cut into clips of four to ten sheets. An appropriate number of clips are stacked one on top of the other and each clip is interleaved, or releasably attached to adjoining clips so that a block of a predetermined number of sheets is formed.

Cutting the continuous stack (e.g., 75, FIG. 10) into discreet blocks (e.g., 76 FIG. 10) of individual interleaved sheets (e.g., S10 and S11) is preferably undertaken at the approximate mid-point of each knee-like protrusion, and approximately halfway between knee-like protrusions, e.g. FIG. 3, 48 and 51 respectively, in a direction essentially perpendicular to the longitudinal axis (e.g. L3 of ribbon R3). This method is preferred because each knee-like protrusion that is formed by stretching the ribbon is cut into two knee-like protrusions, one on each adjoining sheet. Thus, the number of knee-like protrusions that must ultimately be formed is reduced by half. However, any cut line that produces an area of greatest overlap adjacent an area of least overlap along the interleaved edges between adjoining sheets is an acceptable cut line.

The individual blocks (e.g., 76) of folded interleaved sheets (e.g., S10 and S11) are placed in dispensers where one sheet at a time can be dispensed, leaving a convenient tail for the next dispensing. Preferably, lotion (which may contain moisturizers, cleansing agents, water, etc.) is added to the block of sheets while it is being packaged. However, as can be appreciated, lotion can be added at any convenient point during the manufacturing process. As will be appreciated, after the block of individual interleaved sheets are placed in a dispenser, the tail of the first sheet is pulled through and away from the dispenser, which in turn pulls the overlapped section through the aperture of the dispenser. The physical interaction between the sheet being dispensed and the next sheet in the dispenser, causes the two sheets to bond together long enough to remove the area of greatest overlap from the dispenser. As the area of greatest overlap has been removed, a separation front is created at the area of least overlap. As the interaction between the two sheets is decreased, the separation front continues through the interface between the two sheets. The separation front continues until the two sheets are separated leaving a convenient tail of the next sheet remaining above the container.

Having shown and described the preferred embodiments of the present invention, further adaptation of the improved sheet products and method of forming described herein can be accomplished by appropriate modifications by one of ordinary skill in the art without departing from the scope of the present invention. A number of alternatives and modifications have been described herein, and others will be apparent to those skilled in the art. For example, the particular stretching operations might be undertaken manually, and/or the number, location and configuration of the knee-line protrusions and recess or cavity areas can be modified for a variety of products and applications. Accordingly, the scope of the present invention should be considered in terms of the following claims, and is understood not to be limited to the details of the structures and methods shown and described in the specification and drawings.

I claim:

1. An improved method of forming a strata of overlapping sheets suitable for use in a pop-up dispensing system, said method comprising the steps of:

providing a plurality of ribbons of sheet material, with each ribbon having a longitudinal axis and opposed first and second side portions and first and second side edges spaced transversely from said longitudinal axis wherein said second side edge is substantially parallel with said longitudinal axis;

forming one or more protrusions on said first side edge of each of said ribbons by gripping said first side portion at one or more discrete locations and stretching said portion outwardly so as to move said first side edge in a direction laterally away from said longitudinal axis thereby increasing at least one of said ribbon's cross-directional dimensions;

aligning two or more of said ribbons adjacent one another;

overlapping at least a portion of said one or more protrusions of said first side edge with said second side portion of adjacent aligned ribbons to form a strata of overlapped ribbons, creating a series of areas of greatest overlap adjoining areas of least overlap;

folding said strata of overlapped ribbons to form a stack of folded interleaved ribbons; and cutting said stack of folded interleaved ribbons across said longitudinal axis to form a plurality of blocks of individual interleaved sheets.

2. The method of claim 1, further comprising the steps of aligning adjacent ribbons in a direction parallel to their longitudinal axis such that a protrusion of a first side edge of one ribbon is aligned with the second side edge of an adjacent ribbon resulting in a predetermined area of overlap between said side edges of adjacent ribbons.

3. The method of claim 1, wherein said providing and stretching of the plurality of ribbons is undertaken in a substantially continuous process, and wherein said ribbons are stretched by passing the ribbons through a stretching station where each ribbon is stretched to form said protrusions on said first side edges of said ribbons.

4. The method of claim 3, wherein said stretching station comprises at least one stretching device which can contact each of said ribbons and be moved in a direction transverse to said machine direction to selectively provide said protrusions along said first side edge of said ribbons, and a clamping device which can clamp each of said ribbons when said at least one stretching device is moved.

5. The method of claim 4, wherein said clamping device clamps each of said ribbons along said second side edge of said ribbon and is substantially transversely stationary relative to said longitudinal axis as said ribbon is stretched, thereby providing a second side edge which is substantially parallel with the longitudinal axis of a ribbon.

6. The method of claim 1, wherein said plurality of ribbons are formed by passing a base web of sheet material through a cutting station in a predetermined machine direction, such that said plurality of ribbons are formed with their side edges being spaced in a direction transverse to said machine direction.

7. The method of claim 1, wherein said areas of least overlap between ribbons are areas of no overlap between the aligned edges of adjoining sheets.

8. The method of claim 1, wherein said stack of interleaved ribbons is cut in a direction substantially normal to said longitudinal axis and at the approximate midpoint of each overlapping protrusion, and again at points equidistant between each successive overlapping protrusions to form a plurality of blocks of individual interleaved sheets.

9. An improved method of forming a strata of overlapping sheets suitable for use in a pop-up dispensing system, said method comprising the steps of:

providing a plurality of ribbons of sheet material, with each ribbon having a longitudinal axis and opposed first and second side portions and first and second side edges spaced transversely from said longitudinal axis;

forming one or more protrusions on each of said side edges of said ribbons by passing said ribbons through a stretching station where said first and second portions of each ribbon are gripped at discrete locations and stretched so as to move said side edges outwardly and in a direction substantially laterally away from said longitudinal axis to form said protrusions thereby increasing at least one of the cross-directional dimensions of each ribbon, and wherein said one or more protrusions formed on said first side edge extend outwardly from said longitudinal axis in a substantially opposite direction from said one or more protrusions formed on said second side edge;

aligning two or more of said ribbons adjacent one another;

overlapping at least a portion of a protrusion of said first side edge with said second side edge portion of an aligned adjacent ribbon to form a strata of overlapped ribbons, creating a series of areas of greatest overlap adjoining areas of least overlap;

folding said strata of overlapped ribbons to form a stack of folded interleaved ribbons; and cutting said stack of folded interleaved ribbons across said longitudinal axis to form a plurality of blocks of individual interleaved sheets.

10. The method of claim 9, further comprising the steps of aligning adjacent ribbons in a direction parallel to their longitudinal axis such that a protrusion of a first side edge of one ribbon is aligned with a corresponding protrusion of a second side edge of an adjacent ribbon resulting in a predetermined area of overlap between said protrusions of adjacent ribbons.

11. The method of claim 9, wherein said providing and stretching of the plurality of ribbons is undertaken in a substantially continuous process, and wherein said ribbons are stretched by passing the ribbons through a stretching station where each ribbon is stretched to form said protrusions on said side edges of said ribbons.

12. The method of claim 9, wherein said stretching station comprises a first stretching device which can contact each of said ribbons and can be moved in a direction substantially transverse to said machine direction to selectively provide protrusions along said first side edge of ribbons formed therein, and at least one clamping device for contacting each of said ribbons and maintaining said longitudinal axis of said ribbon in a substantially stationary position when said first stretching device is moved.

13. The method of claim 9, wherein said stretching station comprises a first stretching device which can clamp each of said ribbons and can be moved in a first direction away from and substantially perpendicular to said longitudinal axis to selectively provide protrusions along said first side edge of ribbons formed therein, and a second stretching device which can clamp each of said ribbons and can be moved in a second direction substantially opposite to said first direction to selectively provide protrusions along said second side edge of said ribbons, and wherein said longitudinal axis of said ribbon is held in a substantially stationary transverse position when said stretching devices are moved.

14. The method of claim 9, wherein said areas of least overlap between ribbons are areas of no overlap between the aligned edges of adjoining sheets.

15. The method of claim 9, wherein said stack of interleaved ribbons is cut in a direction substantially normal to said longitudinal axis and at the approximate midpoint of each overlapping protrusion, and again at points equidistant between each successive overlapping protrusions to form a plurality of blocks of individual interleaved sheets.

16. An improved method of forming a strata of overlapping sheets suitable for use in a pop-up dispensing system, said method comprising the steps of:

providing a plurality of ribbons of sheet material, with each ribbon having a longitudinal axis and opposed first and second side portions and first and second side edges spaced transversely from said longitudinal axis;

forming one or more protrusions on each of said side edges of said ribbons by passing said ribbons through a stretching station where each ribbon is stretched so as to move at least portions of said side edges relative to said longitudinal axis to form said protrusions thereby increasing at least one of the dimensions of each ribbon, and wherein said one or more protrusions formed on said first side edge extend outwardly from said longitudinal axis in a substantially opposite direction from said one or more protrusions formed on said second side edge, wherein said stretching station comprises a first stretching device which can clamp each of said ribbons and can be moved in a first direction away from and substantially perpendicular to said longitudinal axis to selectively provide protrusions along said first side edge of ribbons formed therein, and a second stretching device which can clamp each of said ribbons and can be moved in a second direction substantially opposite to said first direction to selectively provide protrusions along said second side edge of said ribbons, and wherein said longitudinal axis of said ribbon is held in a substantially stationary transverse position when said stretching devices are moved;

aligning two or more of said ribbons adjacent one another;

overlapping at least a portion of a protrusion of said first side edge with said second side edge portion of an aligned adjacent ribbon to form a strata of overlapped ribbons, creating a series of areas of greatest overlap adjoining areas of least overlap;

folding said strata of overlapped ribbons to form a stack of folded interleaved ribbons; and cutting said stack of folded interleaved ribbons across said longitudinal axis to form a plurality of blocks of individual interleaved sheets.

* * * * *

UNITED STATES PATENT AND TRADEMARK OFFICE

CERTIFICATE OF CORRECTION

PATENT NO. : 5,891,008

DATED : April 6, 1999

INVENTOR(S) : Jane L. Bavely et al.

It is certified that error appears in the above-identified patent and that said Letters Patent is hereby corrected as shown below:

Column 8, line 15 , "comers" should read – corners --.

Column 8, line 16 , "comers" should read – corners --.

Signed and Sealed this

Twenty-second Day of February, 2000

*Attest:*

Q. TODD DICKINSON

*Attesting Officer*

*Commissioner of Patents and Trademarks*